US007828622B1

(12) United States Patent
Brodie et al.

(10) Patent No.: US 7,828,622 B1
(45) Date of Patent: Nov. 9, 2010

(54) SHARPENING METAL CARBIDE EMITTERS

(75) Inventors: Alan Brodie, Palo Alto, CA (US); Mehran Nasser-Ghodsi, Hamilton, MA (US); Ming Yu, Fremont, CA (US)

(73) Assignee: KLA-Tencor Technologies Corporation, San Jose, CA (US)

( * ) Notice: Subject to any disclaimer, the term of this patent is extended or adjusted under 35 U.S.C. 154(b) by 567 days.

(21) Appl. No.: 11/924,530

(22) Filed: Oct. 25, 2007

(51) Int. Cl.
*H01J 9/00* (2006.01)
*H01J 9/04* (2006.01)

(52) U.S. Cl. ..... 445/50; 445/49; 445/51

(58) Field of Classification Search ..... 445/49–51
See application file for complete search history.

(56) References Cited

FOREIGN PATENT DOCUMENTS

JP 53038256 A * 4/1978
JP 54134964 A * 10/1979
JP 59071232 A * 4/1984
JP 11204078 A * 7/1999

OTHER PUBLICATIONS

Kerji Yada, "A New Preparation Method of Refractory Carbides and Their Thermionic Emission Properties", Journal of Electron Microscopy, vol. 31, No. 4, pp. 349-359, 1982.

* cited by examiner

*Primary Examiner*—Mariceli Santiago
(74) *Attorney, Agent, or Firm*—Joshua D. Isenberg; JDI Patent

(57) ABSTRACT

A method for sharpening a metal carbide emitter tip is disclosed. The metal carbide emitter tip is exposed to an oxygen rich, low vacuum environment when the metal carbide emitter tip is at a first temperature. The metal carbide emitter tip is rapidly heated to a higher second temperature at regular intervals of time.

13 Claims, 3 Drawing Sheets

FIG. 1 – Prior Art

SHARPENING METAL CARBIDE EMITTERS

FIELD OF THE INVENTION

This invention generally relates to thermal field emission (TFE) cathode and more particularly metal carbide electron emitters.

BACKGROUND OF THE INVENTION

Thermal Field Emission (TFE) cathodes are commonly used in high-resolution electron probe tools such as scanning electron microscopes (SEM), critical dimension scanning electron microscopes (CD-SEM), and similar devices. A conventional TFE typically employs a needle electrode of tungsten single crystal and a coating layer of zirconium and oxygen formed on the tungsten single crystal tip. A voltage applied to the needle creates a strong electric field proximate the tip of the needle. A combination of the heating and strong electric field causes field emission of electrons from the tip of the needle.

FIG. 1 is a schematic diagram of a conventional thermal field emission cathode 100. As shown in FIG. 1, the TFE cathode 100 includes an emitter tip 102 for emitting an electron beam and a source or a reservoir 104, which is bonded to the shank of the emitter tip 102. The emitter tip 102 may be a single crystal tungsten (W) tip. The reservoir 104 supplies an active metal, e.g., zirconium or similar active metal (Titanium, Hafnium, etc) in the form of a metal compound (oxide, nitride, etc). The TFE cathode 100 also includes a heater 106, which is made from a refractory metal wire and shaped in to a "V" like structure. Typically, the heater 106 is in the form of a tungsten filament. The heater 106 is physically and electrically connected to a conductive pins 108 bonded to an insulating structure. The emitter tip 102 is bonded to the apex of the heater 106. During normal operation, the emitter tip 102 is heated to incandescent temperature of about 1800K. Heat is generated by passing electrical current through the filament 106, which heats the emitter tip 102 by thermal conduction. Electron emission is enhanced by activating the emitter tip 102 with Zirconium or similar active metal (Titanium, Hafnium, etc) in the form of a metal compound (oxide, nitride, etc) from the reservoir 104. By way of example, the emitter tip 102 may be covered by a ZrO coating layer. The end of life of the cathode occurs when the reservoir 104 is depleted. The TFE Cathode requires an operating vacuum of $10^{-9}$ to $10^{-11}$ torr range.

Because the metal carbides have high melting temperatures it may be problematic to weld the emitter tip 102 to the filament 106. Other methods for holding the tip 102 include a Vogel mount where the tip 102 is sandwiched between two blocks, typically carbon blocks, but not limited to carbon blocks. The tip 102 may be flashed by passing current through the carbon blocks to heat the tip. Another method is an indirect heating method where a metal carbide rod can be heated using electron beam bombardment. Here a filament that surrounds the metal carbide rod is heated and thermionic electrons from the filament may be accelerated to the metal carbide rod by applying an appropriate voltage between the rod and the filament.

Electron emission from metal carbides has been studied for several years. Metal carbide cathodes have electron emission properties that make them attractive candidates for stable emission sources in moderate to poor vacuum applications. Single crystal hafnium carbides (HfC) and other metal carbides (TiC, NbC, etc) have been investigated as alternative to W for the use as an electron emitter. The use of HfC <100> provides a highly refractive and relatively low work function (3.4 eV) emitting surface that has a low evaporation rate, is resistant to ion bombardment and sputtering, has a high melting point (~4200K) and a very low surface mobility. These properties enable an HfC emitter source to operate at high current densities and also to have a long lifetime in poor vacuum conditions.

A simple method for preparing refractory carbide suitable for use as emitter tips from metal wires such as Ta, Zr, Hf, Nb and Ti utilizing a solid-vapor reaction is disclosed in "A New Preparation Method of Refractory Carbides and Their Thermionic Emission Properties" by Kerji Yada, in *Journal of Electron Microscopy*, Vol. 31, No. 4, pp 349-359, 1982, the entire contents of which are incorporated herein by reference.

It is desirable to sharpen metal carbide for use as emitters. Sharpened metal carbide tips also have applications in electron microscopy and related fields, such as Atomic Force Microscopes (AFM), and ion beam systems. A conventional method for making a metal carbide emitter sharp tip involves an electro-chemically etching process. In this process a metal carbide tip is immersed in an etching bath, typically NaOH. This technique is sometimes referred to as the "drop off" technique because the etching only takes place at surface of the tip. As the material thins the part that is below the surface eventually breaks and drops off.

Another conventional method for sharpening an emitter tip is to subject a surface of the metal carbide tip to a flux of inert ions, e.g., $Ar^+$ ions from a flood $Ar^+$ source, while rotating the tip about a longitudinal axis. $Ar^+$ bombardment of the surface of the tip breaks and drops off portions of the tip. Another method for sharpening an emitter tip is to expose the tip to $C_2H_4$ to grow a carbon tip on the end of the metal carbide.

Unfortunately, such processes for sharpening the tip typically require removal of the tip from vacuum or disassembly of the dip from the electron probe tool or both for sharpening.

It is within this context that embodiments of the present invention arise.

BRIEF DESCRIPTION OF THE DRAWINGS

Other objects and advantages of the invention will become apparent upon reading the following detailed description and upon reference to the accompanying drawings in which.

DESCRIPTION OF THE SPECIFIC EMBODIMENTS

Figure 1:
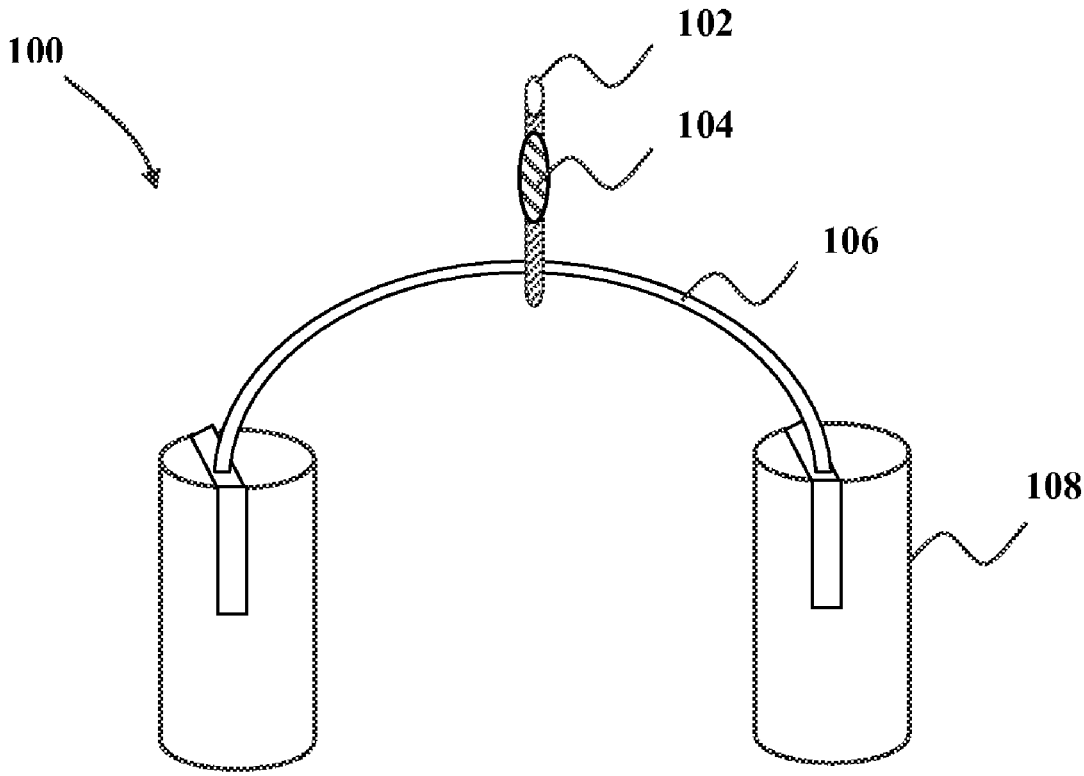
FIG. 1 is a perspective view of a conventional thermal field emission cathode.

Although the following detailed description contains many specific details for the purposes of illustration, anyone of ordinary skill in the art will appreciate that many variations and alterations to the following details are within the scope of the invention. Accordingly, the exemplary embodiments of the invention described below are set forth without any loss of generality to, and without imposing limitations upon, the claimed invention.

In the course of testing the suitability of using HfC in a TFE cathode it was found that HfC emitters tended to fall apart when operated in a poor vacuum environment (e.g., $10^{-4}$ to $10^{-5}$ torr). It was found that the HfC tips tended to fall apart, presumably due to the presence of oxygen ($O_2$). It was also found that an HfC TFE Cathode requires operating in an ultra high vacuum environment of order $10^{-9}$ to $10^{-11}$ Torr to prevent the degradation of the emitter tip. Such findings would ordinarily lead to a conclusion that it is undesirable to expose a metal carbide TFE cathode to oxygen. Consequently, sharpening a metal carbide emitter tip by heating it in the presence oxygen would seem counterintuitive. However, further experimentation has shown that by exposing an HfC TFE cathode to oxygen in conjunction with controlled heating the tip radius may be reduced, thereby sharpening the tip.

In particular, it has been observed that when a TFE cathode containing an etched metal carbide emitter tip, typically HfC emitter tip, is operated at a low vacuum of $1\times10^{-4}$ to $1\times10^{-6}$ Torr and high temperature, HfC degrades rapidly and appears to undergo oxidation reduction in poor vacuum and high temperature. As a result, the HfC emitter tip becomes sharper. In addition to HfC, embodiments of the invention may be applied to sharpening tips made of other metal carbides, including, but not limited to niobium carbide (NbC), tungsten carbide (WC), titanium carbide (TiC), zirconium carbide (ZrC), tantalum carbide (TaC), molybdenum carbide (MoC) and rhenium carbide (ReC).

In embodiments of the present invention, the metal carbide emitter tip may be sharpened in-situ this way while the TFE cathode is assembled to the electron probe tool.

According to an embodiment of the present invention, a metal carbide emitter tip may be sharpened by exposing it to an oxygen-rich, low vacuum environment when the metal carbide emitter tip is at a first temperature. The metal carbide emitter tip may then be rapidly heated to a higher second temperature at regular intervals of time. The metal carbide emitter tip may be heated to the second temperature over a period of time that is less than the regular interval of time. Furthermore, the metal carbide emitter tip may be heated to the second temperature and subsequently cooled to a lower temperature over a period of time that is less than the regular interval of time.

In an embodiment of the present invention, an etched metal carbide (e.g., HfC) tip produced as described above may be operated in an oxygen-rich environment having a partial pressure of oxygen between about $1\times10^{-6}$ Torr to $1\times10^{-7}$ Torr, at a voltage sufficient to draw of order 10 μA of emission current. By way of example, the tip may be run at about 1350K and flashed at elevated temperature of about 2100K to 2400K, e.g., using either static or pulsed heating, at regular intervals, e.g., about every 2 min. There may be a considerable amount of variability in the pulse interval depending on the electronics used to control the pulsing. Pulsing may be done at intervals ranging from a few (e.g., one or more) microseconds to a few (e.g., one or more) minutes.

Figure 2:
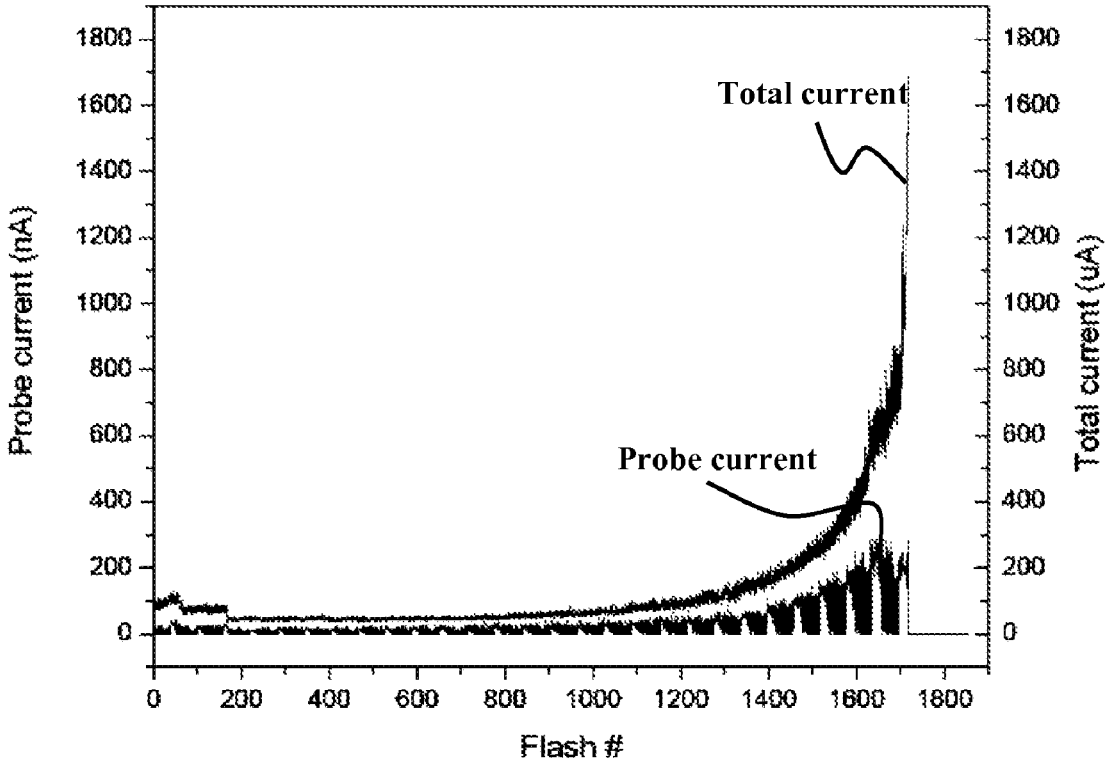
FIG. 2 is a graph illustrating current plots of probe current and total current according to an embodiment of the present invention.

FIG. 2 is a graph showing an increase in current over time for an HfC tip operated in an oxygen rich environment as described above. As shown in FIG. 2, the probe current slightly increased, but the total current rapidly increased and the plot indicated arcing after 1700 flashes with a current draw up to about 1.7 mA, indicating that the tip had became very sharp. In addition, as the current started rising the extraction voltage was lowered. The graph of FIG. 2 illustrates that a controlled process may be used to sharpen the HfC emitter tip. In FIG. 2, the term "total current" is used to describe all the current emitted from the emitter tip. The term "probe current" refers to the amount of current from the emitter tip that passes through an aperture and impinges on a sample.

Figure 3A:
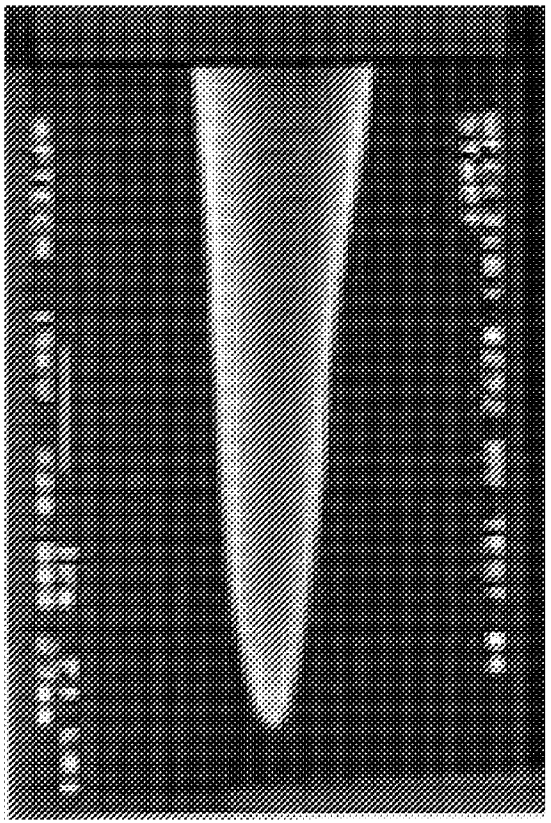
FIGS. 3A-3B are images of the HfC emitter tip before and after operation in an oxygen rich environment at about $10^{-7}$ Torr.
Figure 3B:
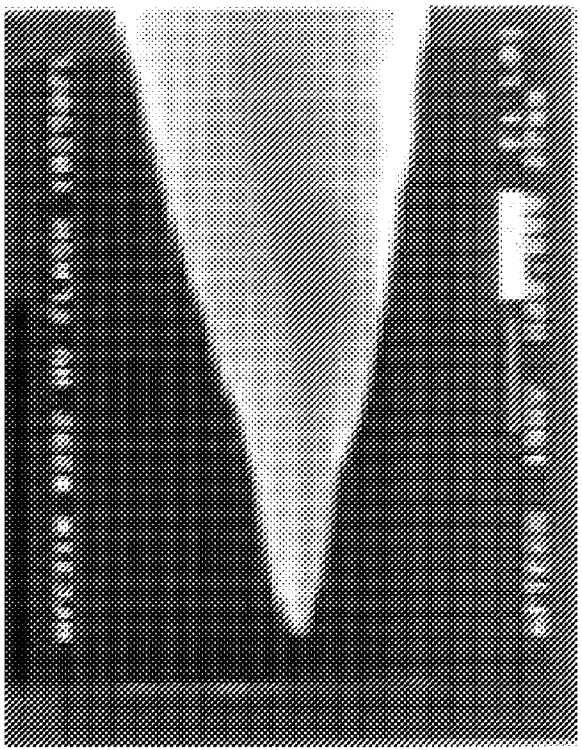

FIGS. 3A-3B are images of the HfC emitter tips before and after the operation in an oxygen rich environment of a partial pressure of oxygen between about $1\times10^{-6}$ Torr to $1\times10^{-7}$ Torr at about 1350K and flashed 10000 times at elevated temperature of about 2100K to 2400K, either static or pulsed, about every 2 minutes as described above. In the example shown in FIGS. 3A-3B, the radius of the tip was reduced from about 130 nm to about 65 nm, corresponding to a sharpening of the tip by a factor of 2. It is noted that the degree of sharpening may be adjusted by increasing or decreasing the number of times that the tip is flash heated.

As used herein the term "about" in conjunction with a numerical value or range of such values implies that the least significant digit in the numerical value may be one greater or one less. Generally speaking the least significant digit is the lowest non-zero digit, unless a zero is indicated or generally recognized as being significant.

As used herein, the term "of order" in conjunction with a specified numerical value or range of such values implies that the number in a range exemplified by the order of magnitude of the specified value. As a rough guide, the range may vary from about half the specified value to about five or ten times the specified value.

While the above is a complete description of the preferred embodiment of the present invention, it is possible to use various alternatives, modifications and equivalents. Therefore, the scope of the present invention should be determined not with reference to the above description but should, instead, be determined with reference to the appended claims, along with their full scope of equivalents. Any feature, whether preferred or not, may be combined with any other feature, whether preferred or not. In the claims that follow, the indefinite article "A", or "An" refers to a quantity of one or more of the item following the article, except where expressly stated otherwise. The appended claims are not to be interpreted as including means-plus-function limitations, unless such a limitation is explicitly recited in a given claim using the phrase "means for."

What is claimed is:

1. A method for sharpening a metal carbide emitter tip, comprising:

a) exposing the metal carbide emitter tip to an oxygen rich, low vacuum environment when the metal carbide emitter tip is at a first temperature; and a) rapidly heating the metal carbide emitter tip to a second temperature that is greater than the first temperature at regular intervals of time.

2. The method of claim 1 further comprising supplying a voltage to the metal carbide emitter tip sufficient to draw an emission current of about 10 μA.

3. The method of claim 1, wherein the oxygen rich, low vacuum environment comprises a partial pressure of oxygen between about $1\times10^{-6}$ Torr and $1\times10^{-7}$ Torr.

4. The method of claim 1 wherein the metal carbide is selected from the group consisting of hafnium carbide (HfC), niobium carbide (NbC), tungsten carbide (WC), titanium carbide (TiC), zirconium carbide (ZrC), tantalum carbide (TaC), molybdenum carbide (MoC), and rhenium carbide (ReC).

5. The method of claim 4, wherein the metal carbide comprises hafnium carbide (HfC).

6. The method of claim 5 wherein the first temperature is between about 1350K and 1750K.

7. The method of claim 5, wherein the second temperature is between about 2100K and 2400K.

8. The method of claim 5 wherein the regular intervals of time range from a few microseconds two a few minutes.

9. The method of claim 1 wherein rapidly heating the metal carbide emitter tip to the second temperature includes static heating or pulsed heating of the metal carbide emitter tip.

10. The method of claim 1 wherein rapidly heating the metal carbide emitter tip includes heating the metal carbide emitter tip to the second temperature over a period of time that is less than the regular interval of time.

11. The method of claim 10 wherein rapidly heating the metal carbide emitter tip includes heating the metal carbide emitter tip to the second temperature and subsequently reducing the temperature of the metal carbide emitter tip over a period of time that is less than the regular interval of time.

12. The method of claim 1 wherein the metal carbide emitter tip is assembled to an electron probe tool, wherein a) and b) take place in situ, without removing the emitter tip from the electron probe tool.

13. The method of claim 1 wherein a) and b) are repeated a sufficient number of times to reduce a radius of the metal carbide emitter tip by a factor of two or more.

* * * * *